United States Patent [19]

Newman

[11] Patent Number: 4,778,072

[45] **Date of Patent: * Oct. 18, 1988**

[54] PRESSURE RELEASE TAMPER INDICATING FEATURE FOR CLOSURE

[75] Inventor: Fred C. Newman, Weston, Conn.

[73] Assignee: Coninental Can Company, Inc., Norwalk, Conn.

[ * ] Notice: The portion of the term of this patent subsequent to Jul. 31, 2004 has been disclaimed.

[21] Appl. No.: 445,135

[22] Filed: Nov. 29, 1982

[51] Int. Cl.[4] ..... B65D 55/02

[52] U.S. Cl. ..... 215/253; 116/70; 215/237; 215/262; 220/231; 220/271; 220/367; 222/153; 222/541

[58] Field of Search ..... 215/235, 237, 250, 253, 215/262, 265; 220/266, 269, 270, 271, 307, 339, 214, 231, 367, 360; 222/153, 541; 116/70, 85, 99, 67 R

[56] References Cited

U.S. PATENT DOCUMENTS 4,157,765 6/1979. Golebiewsky ..... 220/265

4,344,545 8/1982 Aschberger et al. ..... 220/307

4,398,491 8/1983 Fridl et al. ..... 116/67 R 4,407,423 10/1983 Walter ..... 220/307 X

*Primary Examiner*—Stephen Marcus

*Assistant Examiner*—Bryon Gehman

*Attorney, Agent, or Firm*—Charles E. Brown; Paul Shapiro; Charles A. Brown

[57] ABSTRACT

This relates to a closure unit of the type including a closure member lockable in place having secured thereto a lever for effecting unlocking of the closure member. The closure unit has a tamper indicating feature in the form of a rivet projecting from the closure member and being received in a ring member releasably integrally formed with the lever. The rivet has been modified to have a blind hole opening through the underside of the closure member for presentation to the interior of an associated container whereby, should the rivet be severed from the closure member, the blind hole will open to the atmosphere and permit a venting under high pressure of the interior of the container.

5 Claims, 1 Drawing Sheet

PRESSURE RELEASE TAMPER INDICATING FEATURE FOR CLOSURE

This invention relates in general to new and useful improvements in closures particularly adapted for containers having packed therein a product under internal pressure. In particular, this invention relates to a closure of the type which includes a closure member which is locked in place and which has hingedly connected thereto a lever operable to effect unlocking and removal of the closure member.

There has been developed a closure which is formed of moldable plastic material wherein the lever is initially locked or secured to the closure member in overlying relation to the closure member by means of a rivet carried by the closure member and fixedly extending through an annular or ring member rupturably carried by the lever. The rivet and ring member define tamper indicating means which are actuated when the lever is initially lifted.

In this era of tampering, substantially all commercially available closures are being reviewed for possible devious ways of tampering without such tampering being indicated. It has been suspected that the interlock between the lever and the closure, as discussed above, could be released without giving an indication of tampering by inserting a thin blade between the lever and the closure member and severing the rivet at a position where the severing of the rivet would not be apparent.

In accordance with this invention, it is proposed to overcome the possible unobservable tampering by providing the rivet with at least one blind hole which opens on the underside of the closure member and to the product within the container. When the closure unit is so constructed and the rivet is severed, particularly when the product is a liquid, there will be a rapid blowout accompanied by quantities of the product so as clearly to indicate tampering and to prevent any further usage of the product.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
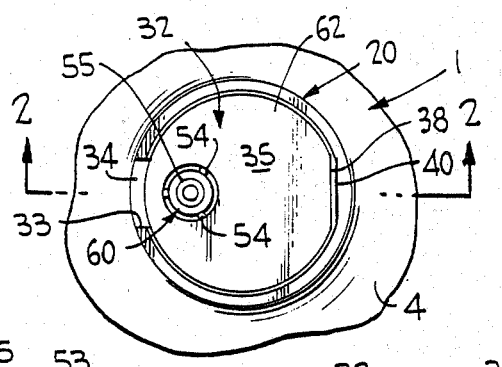
FIG. 1 PRIOR ART
FIG. 1 is a plan view of the prior art closure unit which is being improved in accordance with this invention.

The drawings fragmentarily show an upper end portion 1 of a metal (preferably aluminum) can 2 which has a body and bottom (not shown). The end portion 1 comprises a dome 4 with a narrow integral axially extending neck 5.

The neck 5 comprises a lower generally cylindrical preferably slightly upwardly tapered section 7 which extends upwardly from the dome 4 and merges intermediate the ends of the neck with the outer periphery of an inturned flange or shoulder 9, the inner edge of the flange 9 merging into the lower end of an upwardly flaring frustoconical upper neck section 10 having an internal frustoconical surface 11 which with the interior surface 12 of the lower cylindrical section defines a dispensing or pour opening 13 for filling and discharging a product from the container.

The upper end of the section 10 is formed with an outwardly extending annular bead or hook 14 which is convexed upwardly providing an upwardly facing seating surface 15. The hook projects at its outer edge beyond the outer periphery or circumference of the lower generally cylindrical section of the neck and terminates in a downturned edge or margin 17 and hooks over a stepped-in shoulder 18 on the interior surface 19 or a plastic guard sleeve portion 20 of the closure intermediate its ends.

The sleeve portion has a lower end 22 seated complementally against the tapered top side 24 of the dome section and has a lower portion 25 snugly wrapped about the external surface 27 of the lower section 7. An upper thickened guard portion 29 of the sleeve 20 projects above the plug 30 and encloses an operating lever assembly 32 of the closure.

The guard portion 29 is in the form of a ring with a section cut out at 33 for accommodating a lift tab portion 34 of a lever assembly 32. The remainder of the lever assembly fits within the confines of the ring and is formed as an annular disk having a top wall 35 and a peripheral dependent flange 36. At its side diametrically opposite to the lift tab, the lever is flattened to provide a chordally disposed lever fulcrum edge 38 which opposes a similarly formed chordally extending fulcrum 40 integrated with guard ring 29 and spaced slightly radially outwardly from edge 38. The lever is connected in the area of the fulcrum edge 38 by a strap 42 to the adjacent portion of the top wall 44 of the plug 30.

The top wall 44 of plug 30 has an inwardly disked pressure resistant central portion 45 from which depends a cylindrical hollow closure sleeve 46 which fits into the bore 13. The sleeve 46 has an outwardly projecting annular shoulder 48 at its lower edge which catches under a downwardly facing surface 50 of the shoulder 9. The closure sleeve 46 also has an annular sealing ring 52 with an apical edge 53 in tight engagement with surface 11. Inasmuch as the closure sleeve 46 is made of plastic such as polyethylene or polypropylene or like resin, in the event the container is internally pressurized, the pressure causes the plug to be subjected to an axial load against its top wall, this tightly urging the top edge of ring 52 against face 50. At the same time the pressure in the container expands the closure or plug sleeve 46 radially and tightly engages the sealing ring against the surface 11.

The plug 30 is connected by a strap 52 to the external guard sleeve 20.

In the initial closed position of the closure, the lever is laid over the top wall of the plug and the frangible straps 54 of its anti-pilfer disk 55 are unbroken. The disk 55 is connected by a rivet-like structure 57 formed on and projecting from the top wall 44 of the plug 30. The disk is slidable between the top wall 44 of the plug and the head 53. The lever also has a depending vent stem 58 extending into a vent opening 59 in wall 44 of the plug.

In operation, the lever is lifted by the tab 34 and the tamper indicator generally designated 60 is broken apart and the stem 58 is withdrawn from the vent opening 55. The lever is swung in a clockwise direction about the fulcrum 40 and pulls the tether 42, thus deforming the adjacent portion of the plug and pushing it out of the bore 13. The plug, being connected by the tether 52, is retained with the lever on the container. To reclose, the plug sleeve portion 46 is forced into the bore 13 by applying digital pressure against the top side 62 of the top wall 44 of the plug until the shoulder 48 snaps under the surface 50. Then the lever is laid over the top wall by entering the vent post into the vent opening.

Figure 2:
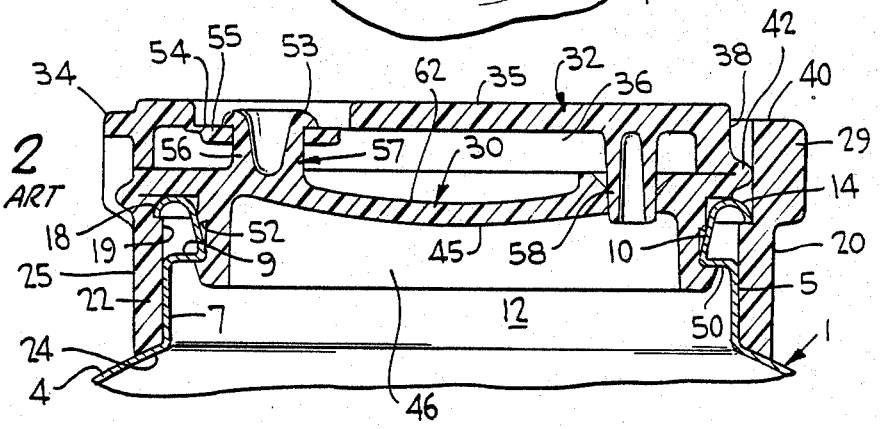
FIG. 2 PRIOR ART
FIG. 2 is a prior art showing taken generally along the line 2—2 of FIG. 1, and shows the details of the prior art closure unit.
Figure 3:
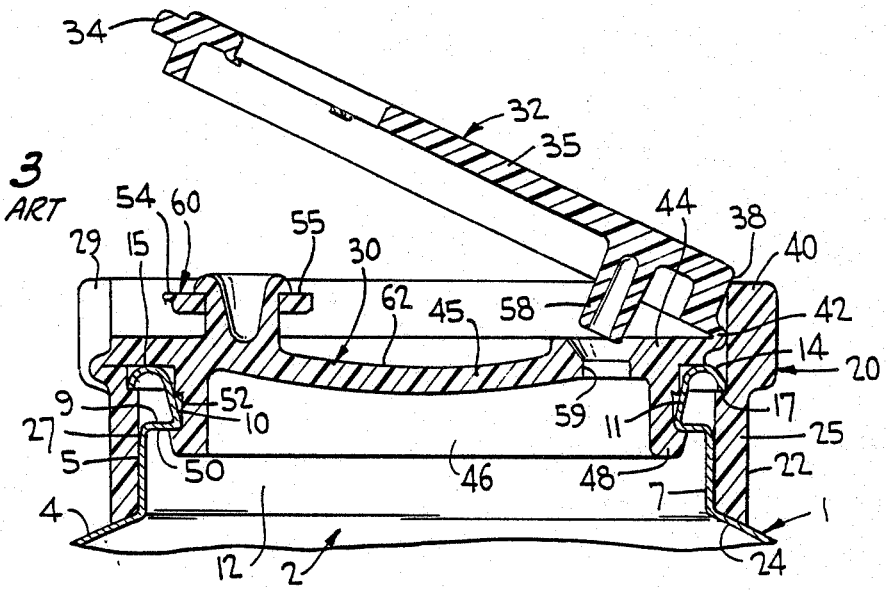
FIG. 3 PRIOR ART
FIG. 3 is a prior art showing in the form of a sectional view similar to FIG. 2, and shows the original tamper indicating feature of the closure unit.

The above described closure unit, particularly as illustrated in FIGS. 1–3, does have a desirable tamper indicating feature in the form of the tearout ring member 60. However, it has been found that it is possible that one who is willing to utilize devious methods to gain entry into the container without actuating the tamper indicating feature as provided for in the original closure unit, may slip a thin, sharp edged blade, such as the blade 70, between the free end of the lever 32 and the upper surface of the closure member 30 and then utilize such blade to sever the rivet 57. In this way, the container may be opened and then resealed, after tampering, without readily visible detection.

Figure 4:
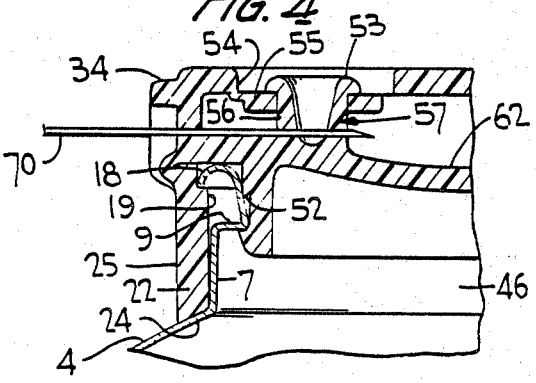
FIG. 4 is a fragmentary sectional view of the left-hand part of FIG. 2, and shows the rivet being severed by means of a thin blade.
Figure 5:
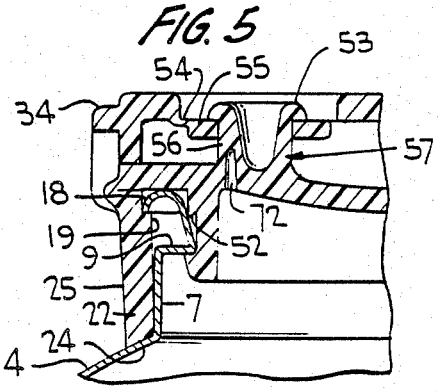
FIG. 5 is another fragmentary sectional view similar to FIG. 4, and shows the tamper indicating feature of this invention.

This deficiency of the prior closure unit has been solved in a very simple manner. The rivet 57 has formed on the underside thereof at least one blind hole 72 as shown in FIG. 5. The hole 72 must extend above the surface of the closure member 30. If a larger hole is required, the hole in the center of the rivet 57 may be foreshortened or made of a smaller diameter. By the simple provision of the blind hole 72, when one attempts to sever the rivet 57 in the manner shown in FIG. 4, one will cut through the hole 72, and this will cause immediate venting of the high pressure within the container and, when the packaged product is a liquid, a venting of the liquid so as to give both an audible and product indication of tampering.

Although only a preferred embodiment of the tamper indicating feature has been specifically illustrated and described herein, it is to be understood that minor variations may be made in the tamper indicating feature without departing from the spirit and scope of the invention as defined by the appended claims.

I claim:

1. A closure unit for a container having therein a product under internal pressure, said closure unit being of the type including a locked in place closure member and a lever hingedly connected to said closure member for effecting removal of said closure member, and there being a tamper indicating assembly normally securing said lever to said closure member for preventing utilization of said lever, said tamper indicating assembly including a tubular rivet carried by said closure member and a detachable tamper indicating member tearably carried by said lever, said tubular rivet having a bore open to the atmosphere and an axially outer part of said rivet being radially out-turned to form a head preventing separation of said tamper indicating member relative to said rivet, the improvement of said rivet having formed therein a blind passage spaced from said rivet bore and opening through a product opposing face of said closure member and forming tamper indicating means opening an associated container to the atmosphere in the event said rivet is severed.

2. A closure unit according to claim 1 wherein said closure unit is carried by a container having packaged therein a product under internal pressure, said container has a combined dispensing and filling opening, and said closure member is sealed relative to said container with said blind passage exposed to the interior of said container and the product packaged therein.

3. A closure unit according to claim 2 wherein the product packaged in said container is a carbonated beverage.

4. A closure unit according to claim 1 wherein said blind passage is radially offset from said bore.

5. A closure unit according to claim 2 wherein said blind passage is radially offset from said bore and in axially overlapping relation thereto.

* * * * *